US006204595B1

(12) United States Patent
Falabella

(10) Patent No.: US 6,204,595 B1
(45) Date of Patent: Mar. 20, 2001

(54) AMORPHOUS-DIAMOND ELECTRON EMITTER

(75) Inventor: Steven Falabella, Livermore, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 08/500,282

(22) Filed: Jul. 10, 1995

(51) Int. Cl.[7] ..... H01J 21/10

(52) U.S. Cl. ..... 313/308; 313/309; 313/310; 313/336; 313/351

(58) Field of Search ..... 313/308, 309, 313/310, 311, 336, 351; 445/24, 51

(56) References Cited

U.S. PATENT DOCUMENTS

| | | | | |
|---|---|---|---|---|
| 5,110,679 | | 5/1992 | Haller et al. | 428/408 |
| 5,279,723 | | 1/1994 | Falabella et al. | 204/192.38 |
| 5,536,193 | * | 7/1996 | Kumar . | |
| 5,548,185 | * | 8/1996 | Kumar et al. | 313/308 |
| 5,578,901 | * | 11/1996 | Blanchet-Fincher et al. | 313/309 |
| 5,600,200 | * | 2/1997 | Kumar et al. | 313/310 |

OTHER PUBLICATIONS

J. Robertson, "Properties of Diamond–Like Carbon", Surface and Coating Technology, 50 (1992) 185–203.

D.R. McKenzie et al., "Compressive–Stress–Induced Formation of Thin–Film Tetrahedral Amorphous Carbon", Phy. Rev. Letts.vol. 67, No. 6, Aug. 5, 1991, pp 773–776.

C.J. Torng et al., "Structure and Bonding Studies of the C:N Thin Films Produced by rf Sputtering Method", J. Mater. Res., vol. 5, No. 11, Nov. 1990, pp. 2490–2496.

D.F. Franceschini et al., "Internal Stress Reductionary Nitrogen Incorporation In Hard Amorphous Carbon Thin Films", Appl. Phys. Lett. 60 (26) Jun. 29, 1992, pp. 3229–3231.

S. Falabella et al., "Fabrication of Amorphous Diamond Films", Thin Solid Films, 236 (1993) 82–86.

D.R. McKenzie et al., "Properties of Tetrahedral Amorphous Carbon Prepared by Vacuum Arc Deposition", Diamond Films '90, Sep. 17–19,. 1990, Switzerland.

* cited by examiner

*Primary Examiner*—Vip Patel
(74) *Attorney, Agent, or Firm*—Alan H. Thompson; L. E. Caranahan

(57) ABSTRACT

An electron emitter comprising a textured silicon wafer overcoated with a thin (200 Å) layer of nitrogen-doped, amorphous-diamond (a:D-N), which lowers the field below 20 volts/micrometer have been demonstrated using this emitter compared to uncoated or diamond coated emitters wherein the emission is at fields of nearly 60 volts/micrometer. The silicon/nitrogen-doped, amorphous-diamond (Si/a:D-N) emitter may be produced by overcoating a textured silicon wafer with amorphous-diamond (a:D) in a nitrogen atmosphere using a filtered cathodic-arc system. The enhanced performance of the Si/a:D-N emitter lowers the voltages required to the point where field-emission displays are practical. Thus, this emitter can be used, for example, in flat-panel emission displays (FEDs), and cold-cathode vacuum electronics.

4 Claims, 2 Drawing Sheets

AMORPHOUS-DIAMOND ELECTRON EMITTER

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to electron emission, particularly to electron emitters for low electric fields, and more particularly to an electron emitter composed of a substrate coated with nitrogen-doped, amorphous-diamond which exhibit emissions at very low electric fields.

Reliable electron emission from cold cathodes, at low electric fields, has long been a goal to be achieved, and particularly for applications such as flat-panel emission displays (FEDs), which requires a cathode that emits at low fields to be practical.

Recently, diamond, diamond-like carbon and amorphous-diamond thin films have become of considerable interest for various applications, and have the potential of becoming an important electronic material due to their special properties. These films are hard, with high thermal conductivity and with high electron and hole mobilities, and can be deposited by several known methods. Diamond-like carbon and amorphous-diamond (ie, disordered tetrahedral carbon), which have characteristics similar to diamond, are being developed due to the high cost of diamond. The following articles set forth properties and exemplify prior development efforts relative to amorphous carbon and diamond-like carbon: J. Robertson, "Properties of diamond-like carbon", Surface and Coatings Technology, 50 (1992), pp. 185–203; D. R. McKenzie et al, "Compression-Stress-Induced Formation of Thin-Film Tetrahedral Amorphous Carbon", Physical Review Letters, Vol. 67, No. 6, August 1991, pp. 773–776; C. J. Torng et al, "Structure and bonding studies of C:N thin films produced by rf sputtering method", J. Mater. Res., Vol. 5, No. 11, November 1990, pp. 2490–2496; and D. F. Franceschini et al, "Internal stress reduction by nitrogen incorporation in amorphous carbon thin films", Appl. Phys. Lett. 60 (26), June 1992, pp. 3229–3231. Also, efforts have been directed to the fabrication of amorphous-diamond films because amorphous diamond (a:D) is a hard, electrically insulating, inert and transparent form of carbon. The fabrication of the amorphous diamond films was carried out using a filtered cathodic arc system such as that of U.S. Pat. No. 5,279,723 issued Jan. 18, 1994 to S. Falabella et al. See S. Falabella et al, "Fabrication of amorphous diamond films", Thin Solid Films, 236 (1993) 82–86; and copending U.S. application Ser. No. 08/047,176, filed Apr. 16, 1993, now U.S. Pat. No. 5,474,816, entitled "Fabrication of Amorphous Diamond Films", in the name of S. Falabella.

While these prior efforts have advanced the state of the art relative to various applications for amorphous-diamond films, it has been recognized that amorphous diamond, when properly doped, can lower the field values for electron emission from cold cathodes. Thus, the present invention is directed to an amorphous-diamond electron emitter, basically composed of a substrate coated with nitrogen-doped, amorphous diamond (a:D-N), which exhibits emission at substantially lower fields than the uncoated substrate or the substrate having a coating of un-doped amorphous-diamond. Preliminary tests show a reduction of required field emission from a cold cathode surface of from over 60 volts/micrometer to less than 20 volts/micrometer, a significant reduction.

SUMMARY OF THE INVENTION

It is an object of the present invention to provide an improved electron emitter.

A further object of the invention is to provide an amorphous-diamond electron emitter.

A further object of the invention is to provide an emitter capable of reliable electron emission from cold cathodes at low electric fields.

Another object of the invention is to provide reliable electron emission from cold cathodes using a textured substrate overcoated with a thin layer of nitrogen-doped amorphous-diamond.

Another object of the invention is to provide a fabrication method for an electron emitter having a nitrogen-doped, amorphous-diamond, thin layer deposited on a textured silicon substrate using a filtered cathodic-arc system.

Other objects and advantages will become apparent from the following description and accompanying drawings. Basically, the invention involves an electron emitter capable of electron emission from a cold cathode at fields below 20 volts/micrometer. The emitter of this invention can be fabricated, for example, from a substrate, such as a textured silicon (Si) wafer, coated with a thin (200 Å) layer of nitrogen-doped amorphous-diamond (a:D-N), using a filtered cathodic-arc system, for example. When needed an adhesive layer may be deposited on the substrate prior to a:D-N layer. Also, the emitter can be fabricated utilizing different deposition techniques. Thus, the electron emitter of this invention enables the use of cold cathodes in applications requiring low electric fields, such as flat-panel emission displays (FEDs).

BRIEF DESCRIPTION OF THE DRAWINGS

The accompanying drawings, which are incorporated into and form a part of the disclosure, illustrate an embodiment of the invention and test results thereof and, together with the description, serve to explain the principles of the invention.

DETAILED DESCRIPTION OF THE INVENTION

Figure 1A:
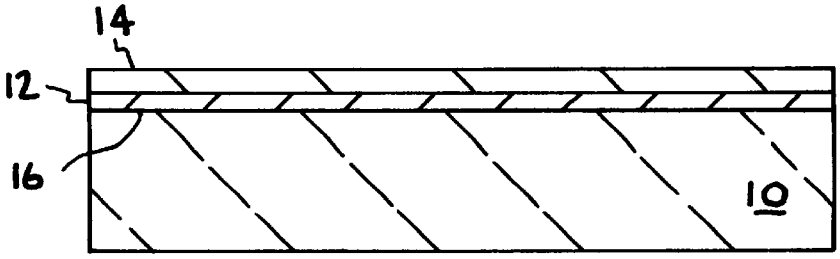
FIG. 1A is a cross-sectional view of an embodiment of the electron emitter invention.

The invention is directed to an amorphous-diamond electron emitter. The emitter of this invention provides reliable electron emission from cold cathodes using a substrate, such as a textured silicon (Si) wafer, that is overcoated with a thin (100 to 5000 Å) layer of nitrogen-doped amorphous-diamond (a:D-N). Where needed to ensure adhesion to the substrate a thin (25 to 100 Å) adhesive layer, such as titanium (Ti), zirconium (Zr), or niobium (Nb), may be used. The nitrogen-doped amorphous-diamond layer may be deposited on the substrate using a filtered cathodic-arc system, such as that described in above-referenced U.S. Pat.

No. 5,279,723, in a method similar to that described and claimed in above-reference copending application Ser. No. 08/047,176, now U.S. Pat. No. 5,474,816 issued Dec. 12, 1995. Basically, carbon ions, from a source, such as a graphite cathode, that produces a carbon ion beam in the 20–200 eV range, are condensed onto the substrate in the presence of a dopant, such as nitrogen, which is generally ionized by the arc plasma and then accelerated by the bias on the substrate, which also adds to the heat flux of the carbon ions. During deposition of the a:D-N layer, the substrate has a negative bias voltage (70–200 volts) and the substrate is maintained at a desired temperature (room temperature or below) by direct or indirect cooling. For example, the cathode arc, such as used in above-referenced U.S. Pat. No. 5,279,723, produces carbon ions with predominantly a single charge, and at a mean energy of 22 eV; and the deposition rate of amorphous-diamond in the filtered cathodic-arc system is about 40 Å/sec. (15 $\mu$m/hr) with an arc current of 100 amps.

The greatest difficulty in applying amorphous-diamond films arises from their high intrinsic stress. This difficulty exists regardless of whether the amorphous-diamond films are deposited with chemical or physical means. For example, a filtered cathodic-arc source produces an ionized beam of carbon at a mean energy of 22 eV which alone produces stress levels of 6–10 GPa on electrically floating substrates. This intrinsic stress can be reduced by increasing the incident ion energy impinging on the substrate. The intrinsic stress in amorphous-diamond films or coatings can be reduced by a factor of two by depositing carbon ions onto a substrate while it is being biased at a voltage that is negative with respect to the substrate being coated. In this method, the substrate is RF biased between about −70 to −200 volts, more preferably, a bias voltage between −70 to −120 volts. Thus, amorphous-diamond films or coatings up to and greater than 8 micrometer may be produced using the filter cathodic-arc system for forming the film on a substrate.

By incorporating a suitable dopant, such as nitrogen, in the amorphous-diamond coating or film, the intrinsic stress is further reduced. For example, by incorporating a dopant, in combination with substrate biasing, described above, will reduce the intrinsic stress of an amorphous-diamond film or coating by a factor of five. Doped, amorphous-diamond films having an intrinsic stress in the range of 1–2 GPa have been produced. Thus, a dopant, such as nitrogen, reduces the intrinsic stress of the a:D-N coating as well as enabling the coating when used in an electron emitter to operate at electric fields below 20 volts/micrometer.

As pointed out above, control of the substrate temperature during deposition of the coating or film therein is important, since it serves to reduce the intrinsic stress and the coating adheres better to the substrate. For example, the substrate may be placed in a cooled holder. Moreover, the coolant may be selected from any heat-conducting medium. Preferably the heat-conducting medium is liquid nitrogen or water. When the substrate is cooled at room temperature the preferred coolant is water. Although, when liquid nitrogen is used as the coolant, the substrate is cooled and coated below room temperature.

While silicon (Si) is the preferred substrate, the substrate can be composed of any flat or textured material composition required as long as an appropriate binder or adhesive layer is used (i.e., aluminum, tantalum, titanium, molybdenum, or glass with a conductive layer). The source of carbon ions, while exemplified above as being a graphite cathode may be from any other carbon ion source. While the preferred dopant is nitrogen, other dopants, such as silicon, boron, aluminum, germanium, and phosphorus can be considered although such have not yet been experimentally verified as having the capability to lower the electric field for electron emission, and/or reduce the intrinsic stress of the coating.

Where needed, the adhesive layer, intermediate the substrate and the doped amorphous-diamond layer may be deposited on the substrate prior to positioning the substrate in the filtered cathodic-arc system. The adhesion layer may be optically, chemically, or physically deposited on the substrate by known techniques, and may be composed of titanium (Ti), zirconium (Zr), or Niobium (Nb), depending on the composition of the substrate.

Figure 1B:
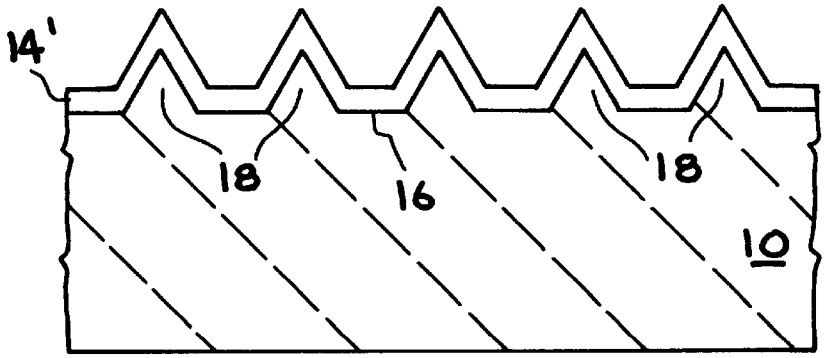
FIG. 1B is a quality enlarged, partial cross-sectional view illustrating the textured surface of the substrate of FIG. 1A.

Referring now to the drawings, FIG. 1A illustrates an embodiment of an electron emitter having a silicon substrate 10 with an adhesive (titanium) layer 12 and an a:D-N (nitrogen-doped amorphous-diamond) layer 14, deposited on the substrate. An upper surface 16 of substrate 10 is textured, and as shown greatly enlarged in FIG. 1B that texture comprises an array of pyramids 18 etched on the surface, with an a:D-N layer 14' deposited directly on the substrate. The array of pyramids 18 may be replaced by an array of sharp points or projections from the surface of the substrate. The pyramids served to enhance the electric field at the tips, which lowers the applied field required for electron emission. The composition of the substrate 10 is not critical but it must be electrically conductive and have points extending from the upper surface. While not shown, the emitter of FIG. 1 will include electric leads for connection to a point of use, as known in the art.

Figure 2:
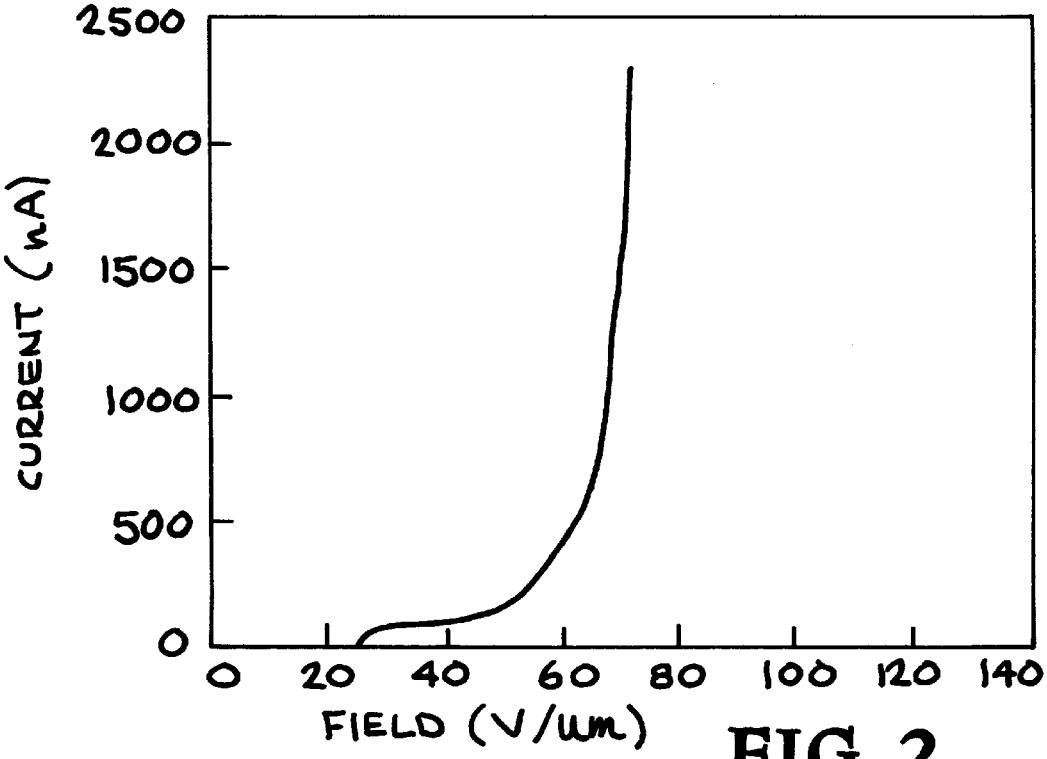
FIG. 2 is a graph illustrating emission characterization of an uncoated silicon (Si) substrate.
Figure 3:
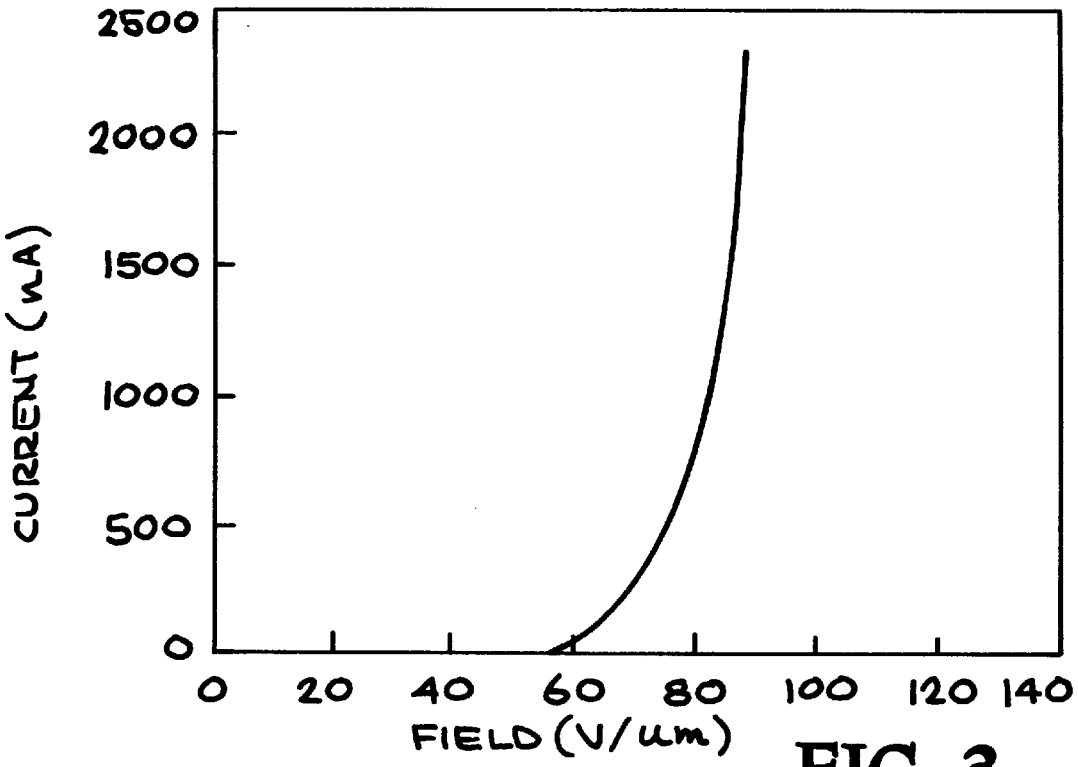
FIG. 3 is a graph illustrating emission characterization of a silicon (Si) substrate coated with amorphous-diamond (a:D).
Figure 4:
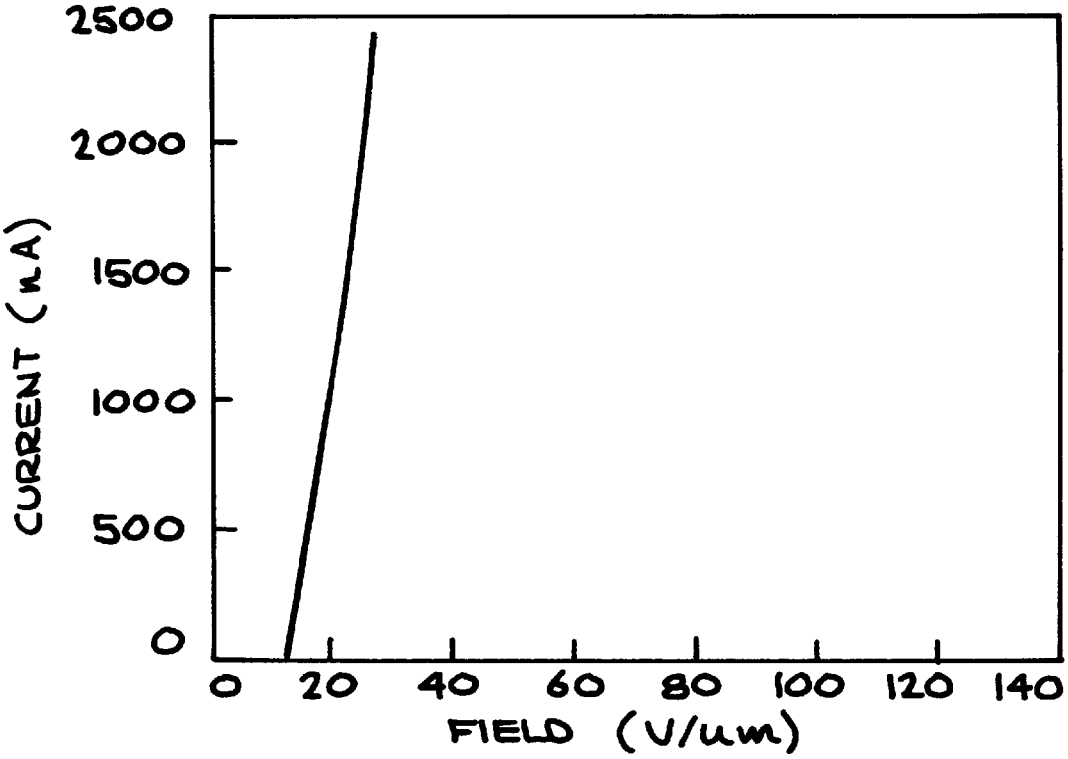
FIG. 4 is a graph illustrating emission characterization of a silicon (Si) substrate coated with nitrogen-doped, amorphous-diamond (a:D-N).

It has been experimentally demonstrated that a:D-N lowers the electric field required for electron emission from a cold cathode surface. A thin a:D-N coating on a textured silicon substrate, for example, yields a surface that emits electrons more readily than the uncoated substrate or an amorphous-diamond (a:D) coated substrate. The coatings contain 3–10 atomic percent nitrogen, typically 7 atomic percent. This enhanced performance lowers the voltages required to the point where field-emission displays are practical. Preliminary tests show a reduction of required field from over 60 volts/micrometer to less than 20 volts/micrometer. A test of a substrate coated with a:D (no nitrogen) shows no improvement over the uncoated substrate, thereby demonstrating the effectiveness of the nitrogen in the coating. This is demonstrated by FIGS. 2, 3, and 4. FIG. 2 is a graph using an uncoated substrate. FIG. 3 is a graph using an a:D coated substrate. FIG. 4 is a graph using an a:D-N coated substrate. It is clearly seen from FIGS. 2–4 that the field is reduced by from over 60 volts/micrometer (V/$\mu$m) to less than 20 V/$\mu$m, a reduction of over ⅔, which is significant. In the tests conducted which resulted in FIGS. 2–4, the substrate was a silicon wafer textured with an array of pyramids etched on its surface, and the a:D and a:D-N coatings had a thickness of 200 Å, with no adhesive layer being used.

By the use of nitrogen doping of the amorphous-diamond layer, the intrinsic stress of the layer has been reduced and electric field for emission has been reduced compared to a layer of amorphous-diamond per se.

The amorphous-diamond coatings and the nitrogen-doped amorphous-diamond coatings utilized in the verification testing were produced on cooled, negatively-biased substrates using a filtered cathodic arc system, such as disclosed in above-referenced U.S. Pat. No. 5,279,723. The cathodic arc source produces a carbon ion beam from a graphite cathode in a high vacuum environment. Macroparticles and neutral atoms are separated from the carbon ions by magnetically guiding the plasma produced at the cathode through a bent tube. The cathodic arc produces carbon ions with predominantly a single charge, and at a mean energy of 22 eV. The deposition rate of amorphous-diamond in the filtered cathodic arc system is about 40 Å/sec (15 $\mu$m/hr) with an arc current of 100 amperes. Amorphousdiamond coatings of greater than 8 $\mu$m have been produced by this system. Nitrogen is directed into the ion beam or around the substrate by introducing nitrogen gas into the chamber through a controlled leak valve to a pressure of 0.2–0.5 mTorr. The nitrogen is ionized by the arc plasma and is then accelerated by the bias on the substrate, which also adds to the heat flux of the carbon ions. The cooling and the negative biasing of the substrate were described above, with the substrate being cooled to room temperature or below and with a negative bias of about −70 to −200 volts, preferable about −70 to −120 volts.

It has thus been shown that the present invention provides an improved electron emitter which will exhibit emission at a substantially lower field, and thus enable reliable electron emission for uses such flat-panel emission displays (FEDs). By doping the amorphous-diamond layer, intrinsic stress of the coating as well as lower field values for emission are reduced, thus providing a significant advance in the state of the art.

While a specific embodiment, specific materials, parameters, and fabrication technique have been set forth to exemplify and teach the principles of the invention, such are not intended to be limiting. Modifications as changes may become apparent to those skilled in the art and it is intended that the invention be limited only by the scope of the appended claims.

What is claimed is:

1. in an electron emitter, the improvement comprising:

a substrate having a textured surface, and a layer of doped amorphous-diamond on the substrate, said doped amorphous-diamond being doped with a dopant material composed of nitrogen, said nitrogrn in said layer of doped amorphous-diamond being in a ratio of 3–10% nitrogen: 90–97% amorphous-diamond.

2. The improvement of claim 1, wherein said substrate is selected from the group consisting of conductive materials and non-conductive material having a conductive layer thereon; and wherein said textured surface includes an array of pointed members.

3. The improvement of claim 2, wherein said substrate is composed of silicon, and wherein said textured surface comprises an array of pyramids etched on the surface.

4. The improvement of claim 1, additionally including an adhesive layer intermediate the substrate and the layer of doped amorphous-diamond.

* * * * *